United States Patent [19]

Decuir

[11] 3,990,510

[45] Nov. 9, 1976

[54] RELEASABLE WELL ANCHOR TOOL

[76] Inventor: Perry J. Decuir, P.O. Drawer 220, New Iberia, La. 70560

[22] Filed: Nov. 18, 1974

[21] Appl. No.: 524,652

[52] U.S. Cl. ..... 166/128; 166/131; 166/182; 166/217

[51] Int. Cl.[2] ..... E21B 23/02

[58] Field of Search ..... 166/209, 206, 212, 215, 166/217, 196, 125, 131, 123, 138, 140

[56] References Cited

UNITED STATES PATENTS

| | | | |
|---|---|---|---|
| 2,976,931 | 3/1961 | Daffin | 166/217 X |
| 3,071,192 | 1/1963 | Raulins | 166/217 |
| 3,101,119 | 8/1963 | Dickens | 166/206 |
| 3,130,788 | 4/1964 | Cochran et al. | 166/217 |
| 3,278,192 | 10/1966 | Tamplen | 166/196 X |
| 3,319,719 | 5/1967 | Decuir | 166/217 |
| 3,430,699 | 3/1969 | Decuir | 166/217 |
| 3,507,329 | 4/1970 | Stone | 166/217 X |
| 3,593,784 | 7/1971 | Brown | 166/217 X |
| 3,874,447 | 4/1975 | McGowen | 166/214 |

*Primary Examiner*—Ernest R. Purser
*Assistant Examiner*—William F. Pate, III

[57] ABSTRACT

A releasable well anchor adapted to be set on a wire line with a running tool attached which comprises an internal and an external mandrel which are slidably mounted with respect to one another having a set of slips on the exterior which slips have two positions, one position being recessed and the other position being radially outwardly of the first to engage the well pipe thereabout in an anchoring positon. The slips are set on movement of an enlargement on the internal mandrel. A set of flexible collet fingers is attached to the internal mandrel, and positioned near first and second internally located receptacles separated by a surface within said external mandrel. The collet fingers flex outwardly into said first or second receptacles on relative movement between said mandrels wherein relative positioning of said collet fingers in said first or second receptacles define a running in position, a setting position, and a retrieval position.

An alternative embodiment utilizes outer and inner mandrels which have interconnecting collet fingers and receptacles in the same manner as the first embodiment. It carries a packer element near the lower end, not the upper end, and the packer element is expanded on manipulation of inner and outer lower mandrels. The lower inner mandrel has a set of collet fingers which have teeth or serrations on the outer surface. The lower outer mandrel incorporates an inwardly facing set of mating serrations. The two sets of serrations cooperate to lock the lower inner and outer mandrels in altered relative longitudinal position, causing expansion of the packer element. They cooperate with the upper outer and inner mandrels to prevent release of the tool on withdrawal of the slip means in the event of bottom hole pressure differential. The apparatus is adapted to be run and set in a manner similar to the first embodiment on a running tool.

A third embodiment utilizes inner and outer mandrels which are arranged somewhat differently from the other embodiments.

15 Claims, 11 Drawing Figures

FIG. 3
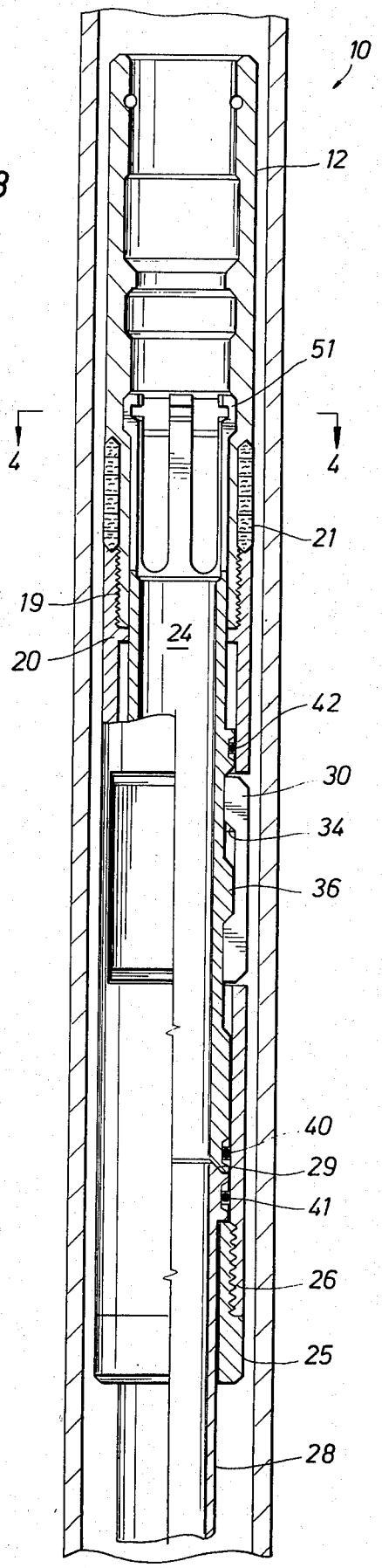
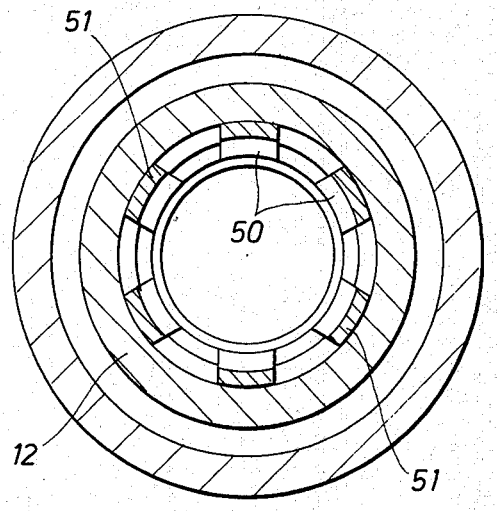
FIG. 4
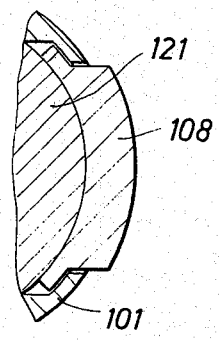
FIG. 9

RELEASABLE WELL ANCHOR TOOL

PRIOR ART

| | |
|---|---|
| 3,430,699 | 2,948,340 |
| 3,102,593 | 3,126,059 |
| 2,948,339 | 3,319,719 |

BACKGROUND OF THE INVENTION

It is helpful to sometimes place a releasable anchor in a well casing pipe at a specified location. Sometimes an anchor will be set in a well and left indefinitely, perhaps for the life of the well. At other times, it will be left only a week or two and thereafter removed. A releasable well anchor of the sort to which the present invention relates which can be set and released with a degree of certainty on the part of the operator at the well head is quite useful. After retrieval, the anchor of the present invention can be subsequently reused time and time again.

Some well anchors function on release without regard to bottom hole pressure differential. This can be hazardous inasmuch as the anchor can be differentially loaded by the bottom hole pressure. The present invention is able to cope with this problem. The well anchor tool incorporates apparatus which responds to bottom hole pressure, locking the tool so that retrieval is not possible so long as pressure differential across the tool exists. This can be overcome by closing off the well at some point thereabove, thereby eliminating the differential. When the differential has been relieved, the tool can be released. With this precaution, the operator avoids the danger of releasing an anchor which would become free and possibly act as a missile in the pipe under the urging of the pressure differential.

SUMMARY OF THE INVENTION

The setting tool of the present invention comprises an apparatus which is attached to a running tool on a wire line. The wire line is manipulated from the well head while the running tool and the anchor of the present invention are lowered in the well. The wire line is lowered into the well until the anchoring tool reaches the desired elevation. The anchoring operation is thus initiated by manipulation of the wire line to operate the running tool. The running tool manipulates the anchor of the present invention to shift it internally from a running position to an anchor position. To accomplish this, the present invention incorporates an internal and an external mandrel which are slidably mounted with respect to one another.

The outer mandrel supports slip means which face outwardly against the casing or pipe surrounding the anchor tool of the present invention. The inner mandrel carries an enlargement which is remote from the slip means when the tool is being run to the well. However, when the inner mandrel is manipulated with respect to the outer mandrel, the enlargement moves to a position opposite the slip means to force the slip means radially outwardly into engagement with the surrounding pipe or casing. This anchors the tool of the present invention in the pipe.

A number of collet fingers are attached at the upper end of the slidably inner mandrel. The collet fingers are adjacent to a first receptacle, a second receptacle and a surface means separating said receptacles within said outer mandrel. When the tool is being run into the well, the collet fingers are positioned adjacent to the surface means while engaged by the running tool. When the running tool is removed, the collet fingers are moved upwardly into the second receptacle by removal of the running tool. This pulls the inner mandrel up and sets the slips to anchor the tool. Subsequent retrieval can be had through the use of a pulling tool, quite similar to the running tool, wherein the collets are engaged and forced from the second receptacle over the surface means and into the first receptacle. This disengages the slip means from the well.

An alternative embodiment is disclosed which utilizes upper inner and outer mandrels and lower inner and outer mandrels. The upper mandrel incorporates the internally facing receptacles of the first embodiment. The upper inner mandrel carries a set of collet fingers which have knuckles which fit in the receptacles in the same manner. When the knuckles engage the lowermost receptacle, the slip means are retracted, enabling the tool to be retrieved or run in the well. When the knuckles on the collet fingers fall into the upper receptacle, the slip means are extended. This enables the tool to be anchored. Inner and outer lower mandrels are also incorporated. They are selectively engaged by means of a set of collet fingers on the inner lower mandrel which carry teeth or serrations which comprise portions of a helix or thread about the collet fingers. The upper outer mandrel has a matching set of internally directed threads or teeth. The spring action of the collet fingers forces the teeth together, thereby securing the lower inner mandrel in a raised longitudinal position. This position expands an external packer which seals against the surrounding well pipe. The lower inner mandrel collet fingers are chamferred about their top edge and the upper inner mandrel has a matching chamferred surface. When the upper inner mandrel moves downwardly, it disengages the collet fingers on the lower inner mandrel from the surrounding serrations to release the lower packer and move the lower inner mandrel to its lowermost longitudinal position.

A third embodiment is disclosed which utilizes inner and outer mandrels. The outer mandrel incorporates internally facing receptacles of the first embodiment. The inner mandrel carries a set of collet fingers which have knuckles which fit in the receptacles in the same manner. When the knuckles engage the lowermost receptacle, the slip means are in the retracted position. When the knuckles on the collet fingers fall into the upper receptacle, the slip means are extended. This enables the tool to be anchored.

DESCRIPTION OF THE DRAWINGS

FIG. 3 is a similar sectional view through the tool showing the position of the collet for retrieval wherein the slip means has been withdrawn from engagement with the pipe wall;

FIG. 4 is a sectional view along the line 4 — 4 of FIG. 3 showing details of construction of the collet fingers;

FIG. 9 is a sectional view showing an undercut window in the mandrel through which the slip means can expand without falling through the window.

DESCRIPTION OF THE PREFERRED EMBODIMENT

Figure 1:
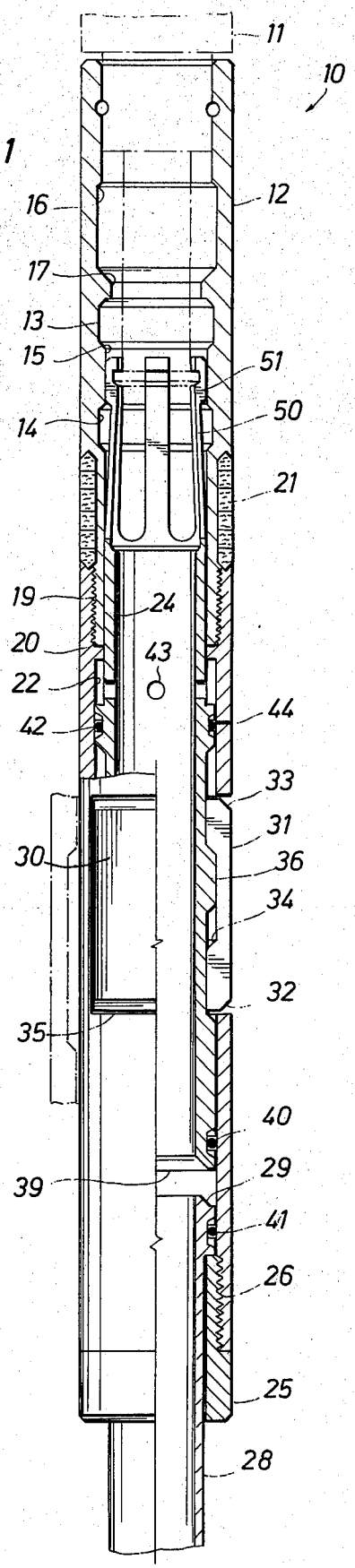
FIG. 1 is a sectional view taken along the anchor tool of the present invention in the running in position on a running tool.

Attention is first directed to FIG. 1 of the drawings where the tool of the present invention is identified by the numeral 10. It is adapted to be placed in a well on a running tool 11. One such suitable running tool is the type "GS" running or pulling tool of the Otis Engineering Corporation, Dallas, Texas. Such a running tool incorporates a core of fixed diameter and has a number of flexible dogs which are supported by the core to define an upwardly facing shoulder of a certain diameter. When the dogs are pulled toward the core, they are free to flex inwardly to a smaller diameter, thereby clearing the running tool for retrieval from the tool of the present invention.

The running tool 11 is engaged with the upper end of the tool of the present invention. The present invention incorporates an upper mandrel 12 which is provided with a first internal receptacle 13 and a second internal receptacle 14. The receptacles 13 and 14 are separated by a surface means 15. As viewed in the drawings, the receptacles 13 and 14 have the form of internal grooves while the surface means has a reduced diameter. The receptacles 13 and 14 are defined by shoulders which extend at about a 45° angle. The surface means 15 is preferably polished. The function of the receptacle means 13 and 14 and the surface 15 therebetween will be defined hereinafter.

The upper mandrel 12 incorporates an internal shoulder 16 which is adapted to engage a fishing tool in the event the tool of the present invention is to be retrieved. An inwardly directed lower shoulder 17 is contoured to cooperate with a grappling or fishing tool on retrieval.

The upper mandrel 12 is threadably connected at 19 to an outer mandrel 20. A seal means 21 prevents leakage at the threaded connection between the upper mandrel 21 and the outer mandrel 20. The outer mandrel 20 has an internal surface 22 which slidably supports and contacts an inner mandrel 24. The outer mandrel 20 extends toward the lower end of the tool and receives a threaded sub 25 at its lower end. The two are joined together at the threaded connection 26. The sub 25 secures in position a lower anchor 28 which has an enlargement at 29. The anchor 28 is slidable up and down to an extent determined by the position of the inner mandrel 24 with respect to the outer mandrel 20. The anchor 28 is made available for connection to any other tool of interest. Thus, it may be threaded at its lower end, equipped with a collet connected mechanism, or any other apparatus for interconnection with a cooperative tool.

The outer mandrel 20 defines the outer surface of the tool except for a plurality of slips 30. Preferably, two or three slips are arranged about the circumference of the tool. The slips are better shown in sectional view in FIG. 1. The slips have an outer surface 31 which faces the well casing or pipe in which the tool is to be anchored. This surface is preferably hardened to extend its life. The slips 30 are chamfered at 32 and 33. An internal recess is formed at 34 within each of the slips. The recess extends partly along the length of the slips. The recess is defined at its upper and lower ends by facing shoulders which extend at an angle of approximately 45°. The facing shoulders preferably are not perpendicular but they are inclined to permit them to ride over an enlargement as will be described. The slips 30 do not extend fully about the circumference but are received in windows or ports formed in the outer mandrel. The slips are held in position within the windows 35 formed in the outer mandrel 20.

The inner mandrel 24 has an enlargement 36 which is received within the recess 34 in the slips. The enlargement 36 extends fully about the inner mandrel and thus contacts all of the slips which are positioned on its exterior. In the preferred embodiment, three or four individual slips are used although the number can be increased or decreased as required. Moreover, the enlargement 36 has a pair of tapered shoulders which match the shoulders on the interior of the slips. The shoulders that engage one another are preferably tapered so that the slips 30 ride over the enlargement 36. Thus, on upward movement of the enlargement 36, the slips are forced radially outwardly and into contact with the surrounding casing or pipe wall.

The inner mandrel 24 terminates at its lower end 39. The lower end 39 is adjacent to the slidable anchor member 28. Both members are provided with external grooves and seal members 40 and 41. The tubular members are spaced apart in the position of FIG. 1 and are further apart when the tool is set or locked. However, during retrieval as will be described, the two members are in abutting position as shown in FIG. 3.

The inner mandrel is provided with an upper seal 42. The seal is below a plurality of ports 43 through the inner mandrel. The ports 43 are selectively communicated with an external passage or port 44 through the outer mandrel. When the tool is being run into a well, fluid communication through the ports 43 and 44 is permitted. However, when the tool has been set, the seal 42 is interposed between the above mentioned ports and prevents further communication. More will be noted concerning this hereinafter.

One important feature of the present invention is the incorporation of a number of flexible collet members 50 attached to the upper end of the inner mandrel.

The collets 50 in the preferred embodiment have the form of three or four elongate fingers attached to the upper end of the inner mandrel 24. They are flexible and able to bend. Each collet has an enlargement or knuckle 51 near its outer end. The knuckle 51 has a length and pair of shoulders shaped to match the internal receptacles 13 and 14 formed in the upper mandrel. More specifically, the knuckles at the end of the collets 50 are adapted to be received within the receptacles 13 and 14 or to be supported on the surface means 15 as illustrated in FIG. 1. The knuckles have three positions which are, considered from the top to the bottom of the tool, received within the receptacle 13, supported on the surface 15 or positioned in the receptacle 14. Thus, the collets 50 will be observed to cooperate in positioning the mandrel 24 which is attached thereto at three positions. The three positions and their relationship to the operation of the tool will be set forth hereinafter.

FIG. 1 shows the collets in a first position which is on the surface 15. This is the position which is associated with running in the tool. This is the position where the slips are withdrawn. This is the position where the anchor tool of the present invention is supported on a running tool and can be manipulated in a well through the use of a wire line.

Figure 2:
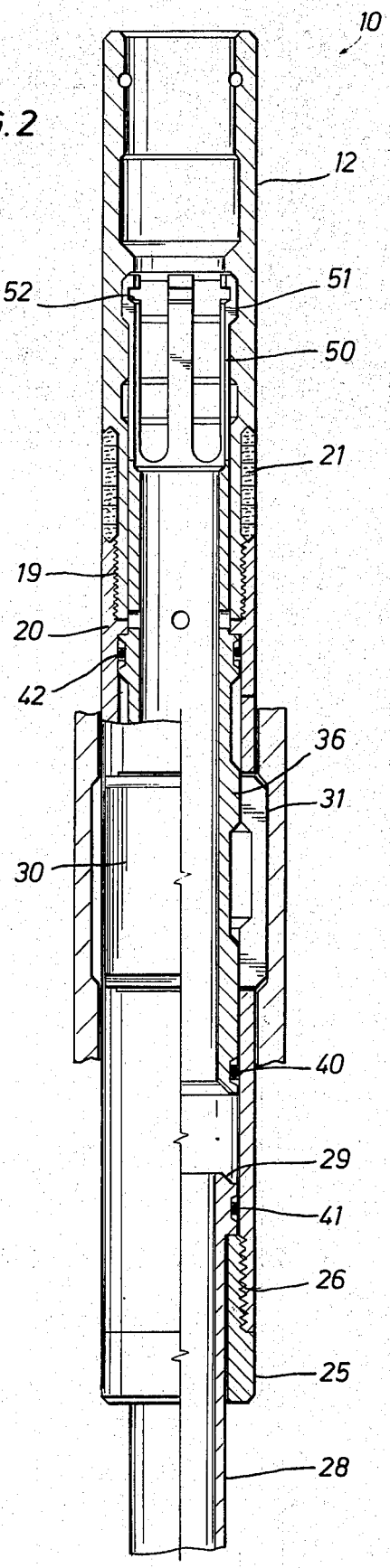
FIG. 2 is a sectional view similar to FIG. 1 showing the tool in a set or locked position after removal of the running tool.

FIG. 2 of the drawings illustrates the knuckles on the collets received in the upper receptacle. This is the position at which the tool is locked or anchored. This is the position of the collets and the inner mandrel 24 after moving upwardly to position the dogs for engaging the well pipe or casing to thereby position, anchor and hold the tool of the present invention indefinitely.

Attention is directed to FIG. 3 of the drawings which shows the collets received in the lower receptacle 14. This is the position where the tool can be retrieved. With the collets in this position, the slips are withdrawn, thereby freeing the tool and permitting its retrieval. With the collets in this position, the inner mandrel 24 is in the down position with respect to the outer mandrel.

The collets 50 possess an internal cut out or notched portion 52 (FIG. 2) which is adapted to receive a surrounding flange of a retrieving tool. In operation of the tool of the present invention, the notch 52 is used to engage the collets with disc on a running in tool which forces the collets to move into the upper receptacle 13. This movement is accompanied by movement of the inner mandrel as shown in the contrast of FIGS. 1 and 2. Of significant interest is the fact that upward movement of the inner mandrel 24 repositions the enlargement 36 on its exterior. The enlargement 36 moves into the recess 34 on the inner face of the slips 30. Thus, the dogs are forced outwardly into the locking position against the well pipe or casing. This locks the tool at a fixed elevation in a nipple and permits subsequent movement in the well bore.

The tool of the present invention is particularly adapted for repeated operations. The positions of FIGS. 1, 2, and 3 can be achieved time and time again through the repeated use and manipulation of the tool on a wire line running in tool. The tool of the present invention is adapted for reuse and to this end, the three positions are provided for the collet mechanism on the upper end of the inner mandrel. The inner mandrel is thus locked one of three positions during its operation depending on the position of the collets.

Figure 5:
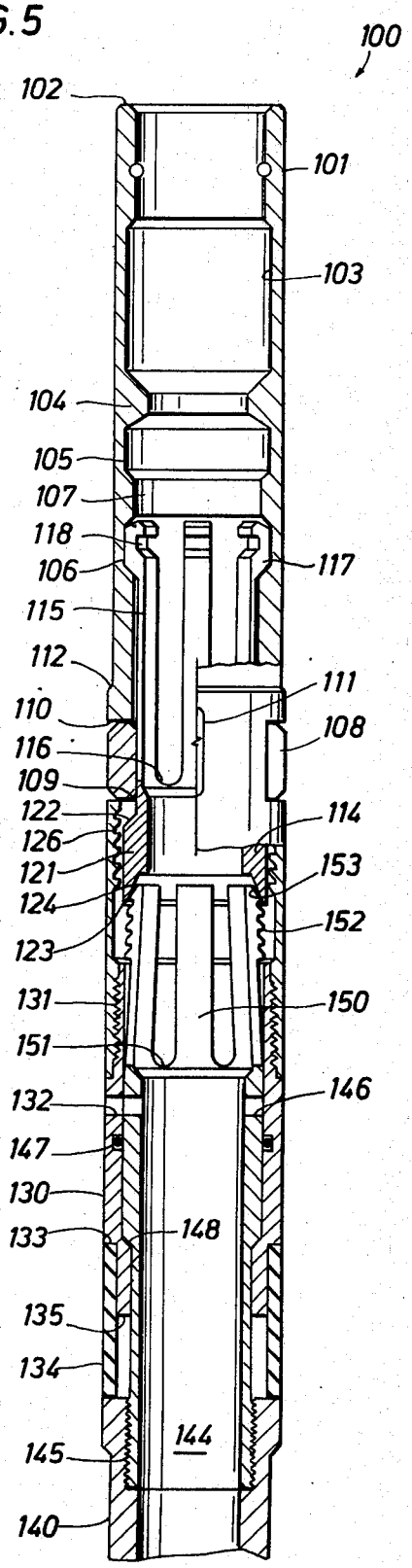
FIG. 5 is a longitudinal sectional view of an alternative embodiment of the well anchor of the present invention showing the tool postured for retrieval.

An alternative embodiment 100 is shown in FIGS. 5 - 8. The construction of the tool will be set forth first, and its operation detailed thereafter. FIG. 5 shows the tool in the retrieval position.

An upper outer mandrel 101 has an extended neck at 102 and an internal recess 103 for engagement with a fishing tool. An inwardly directed shoulder 104 cooperates with the fishing and retrieving equipment. The shoulder 104 is adjacent to an upper internal grooved receptacle 105. The receptacle 105 is formed by a pair of facing shoulders which are preferably extended at about 45° angles. The receptacle 105 is an encircling cut in the wall of the upper outer mandrel 101. The receptacle 105 matches the outer contour of a set of collet fingers as will be described.

The mandrel 101 includes a second or lower receptacle 106 which is similar in shape or contour to the receptacle 105. The two are separated by surface means 107. The surface means 107 is at a point of reduced internal diameter. The surface 107 is between the receptacles 105 and 106. The surface 107 defines a surface on which collet fingers to be described can rest. This will be discussed hereinafter.

The mandrel 101 has a number of windows formed in its lower portions and a number of dogs 108 which comprise a slip means extend through the windows. The dogs 108 are tapered at the lower inside edge 109 to enable them to ride over an enlargement as will be described. The slip means 108 move radially inwardly and outwardly of the windows 110 formed in the mandrel 101. They are captured in the windows 110 by an inside edge laterally projecting shoulder extending along both sides of the longitudinal dimension. The shoulder extends under the edge of the window 110 so that the slip means 108 cannot fall out through the windows. The dogs 108 are wider than the windows 110 at their base dimension.

The outer mandrel 101 includes an elongate port or opening 111 which is positioned adjacent to one of the slip means. Three or four slip means about the periphery are adequate to provide locking of the anchor 100. The slip means are located at a thickened portion of the outer mandrel 101 which is found below a shoulder 112.

The outer mandrel 101 surrounds an inner upper mandrel 114 which has a number of collet fingers 115 at its upper end which extend upwardly, separated by a number of slots 116 which are cut in the inner mandrel 114. The collet fingers have an enlarged knuckle 117 which surrounds an internal undercut 118. The under cut portion 118 is found in each knuckle, facing inwardly, so that on inward flexure, a shear disc can be grasped and released.

The knuckles 115 on the upper end of the collet fingers are shaped and contoured to fit in the receptacles 105 and 106. They are also shaped to slide over the surface 107 between them. This enables the inner mandrel 114 to be positioned at a specified location relative to the outer mandrel. The position of the inner mandrel and outer mandrel with respect to one another is determined by engagement of the knuckles on the ends of the collet fingers.

The inner mandrel 114 is thickened at its lower edges to define an enlargement 121 which is tapered at its upper edge 122 to enable it to slide under the slip means 108, thereby forcing the slip means radially outwardly. The enlargement 121 forces radial movement outwardly of a distance to move the lock keys 108 to a locking position. The enlargement 121 fits within the outer mandrel 101 when the inner mandrel is in the lowermost position of FIG. 1. When it is raised, the collet fingers 115 land the knuckles 117 in the upper receptacle 105, thereby positioning the enlargement 121 immediately adjacent to the slip means 108, causing it to expand and move outwardly.

The inner mandrel 114 terminates at a lower tapered lip 123. The edge 123 defines an internal chamferred shoulder 124 which cooperates with additional apparatus to be described. The outer mandrel 101 incorporates a number of internal upwardly facing serrations 126. The serrations 126 are preferably fully circular on the interior of the mandrel just below the slip means 101. They face upwardly to permit upward movement of a mating set of serrations, but locking against relative downward movement as will be described.

A lower outer mandrel 130 is threaded to the upper outer mandrel at 131. The lower mandrel has a single opening 132. The mandrel 130 has a downwardly facing shoulder 133 which provides support for a packer element 134. The packer 134 rests on the outside of the lower portions of the outer lower mandrel 130. The lower outer mandrel 130 terminates at a shoulder or face 135 which faces downwardly. A clear space or span behind the packer element is defined. The packer 134 is supported at its lower end by a packer sub 140 which abuts the lower edge of the packer element 134. The sub is able to move upwardly through the clear span until it abuts the lower face or shoulder 135 of the lower outer mandrel 130. This abutting relationship limits the upward movement of the packer sub and the compression of the packer. When it moves upwardly, the packer is expanded radially outwardly to seal in the well bore.

The packer sub 140 is threaded to a lower inner mandrel 144. The threaded connection is found at 145. The lower inner mandrel 144 has an enlarged portion beginning at a shoulder 148. As shown in FIG. 5, this limits downward travel by coaction with a similar or mating shoulder on the lower outer mandrel 130. In this downward position of the inner mandrel 144, a pair of diametrically opposed openings 146 are aligned with the opening 132. The three openings enable a shear pin to be placed in the openings as will be described. The mandrel 144 is sealed to the outer mandrel 130 by an encircling O-ring 147.

The mandrel 144 has a number of collet fingers 150 which extend from its upper end. The collet fingers 150 are separated by adjacent slots 151 which define the width of the collet fingers and the flexure of the collet fingers 150. The collet fingers have a set of matching serrations 152 on the exterior which face downwardly. The serrations match the serrations 126 previously defined. The two sets of serrations engage and prevent relative downward movement of the inner mandrel 144. However, this is achieved after relatively easy upward movement from the downmost position of FIG. 5. The collet fingers 150 have a tapered edge or face 153 which encircles the upper outer edge to enable the matching chamferred shoulder 124 of the upper inner mandrel. When the upper inner mandrel is in the down position, it surrounds the collet fingers, deflecting them inwardly and bending them away from the matching serrations 126. The upper inner mandrel can ride over the collet fingers on the lower inner mandrel, defeating the locking position of the serrations of the collet fingers. More will be noted concerning this hereinafter.

Figure 6:
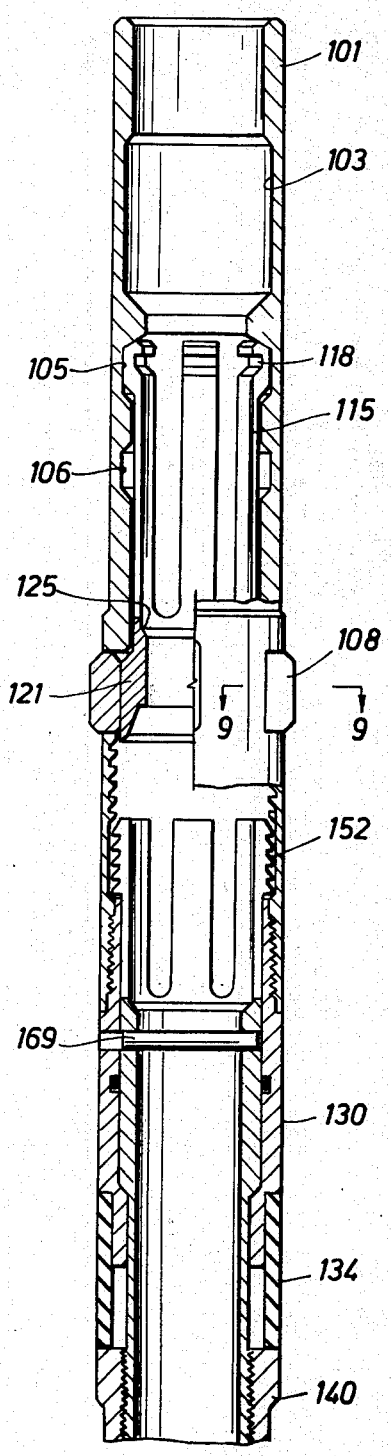
FIG. 6 shows the well anchor of FIG. 5 after expansion of the slip means to anchor the tool.
Figure 7:
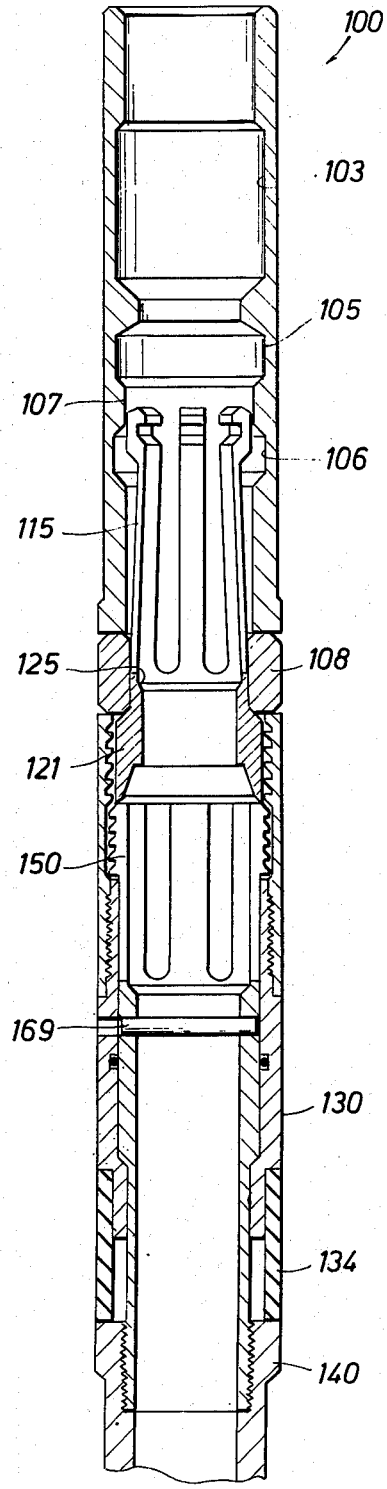
FIG. 7 shows the running tool in the running - in position.
Figure 8:
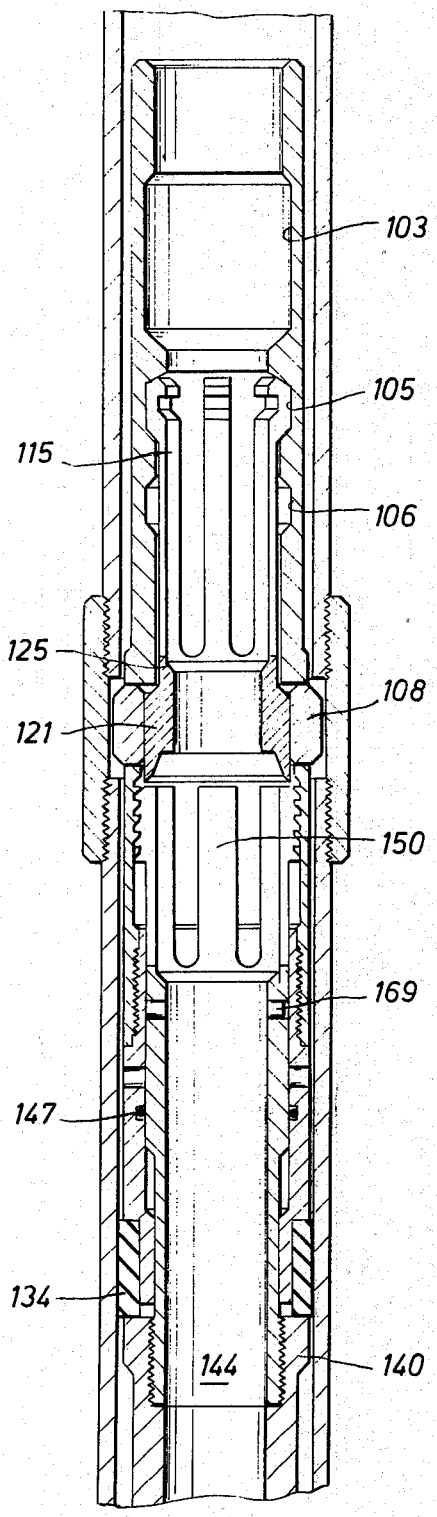
FIG. 8 shows the alternative embodiment anchored or locked in a well where the slip means have been expanded and the packer means have been expanded.

The embodiment 100 has been shown in four views. In FIG. 8, it is shown locked in a tubing string at a collar. The dogs move radially into the collar and the expandable element 134 provides a fluid seal below preventing flow on the exterior of the anchor. In FIG. 7, the same anchor is shown in the running configuration. FIG. 5 shows the tool 100 arranged for retrieval after it has been set in a tubing string. FIG. 6 shows the dogs locked in the expanded condition and also shows a pin 169 which can be used with a running tool to pull the mandrel 140 up to expand the packer 134. The pin 169 is shearable.

The embodiments 10 and 100 both include apparatus preventing release of the well anchor under bottom hole differential pressure. Release of the tool at a time that a pressure differential has accumulated is likely to rapidly propel the released anchor uphole, damaging anything in its path. The two versions have in common hollow mandrels which are forced upwardly by pressure to block or prevent release of the slip means. The inability of the slips to release is a warning that pressure control steps must be taken prior to release. Once the differential is controlled, the tool can be safely released.

Figure 10A:
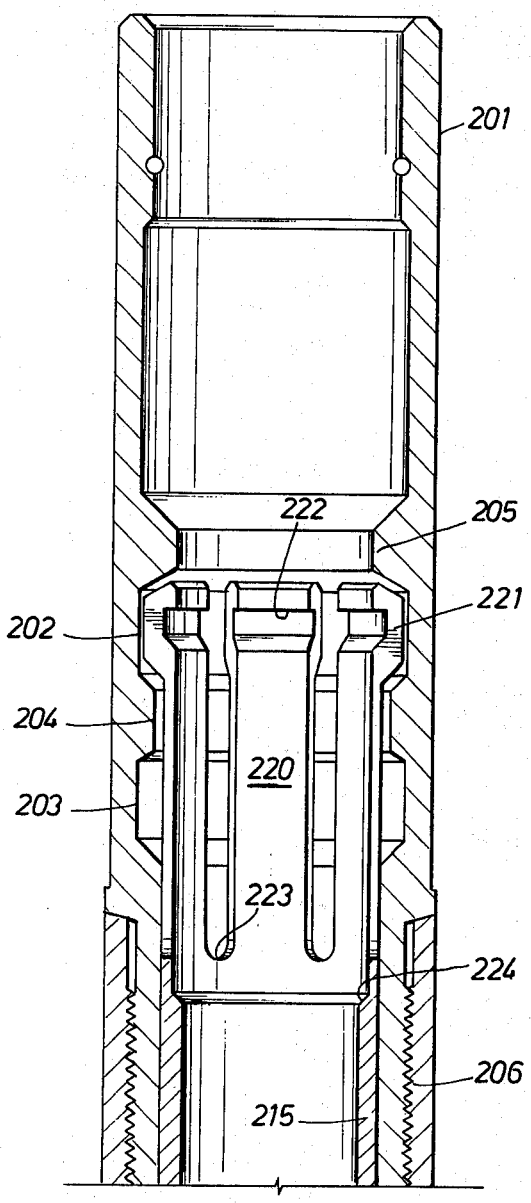
FIGS. 10A and 10B jointly show the third embodiment of the anchor tool in the locked position where the slips are expanded to anchor the tool.
Figure 10B:
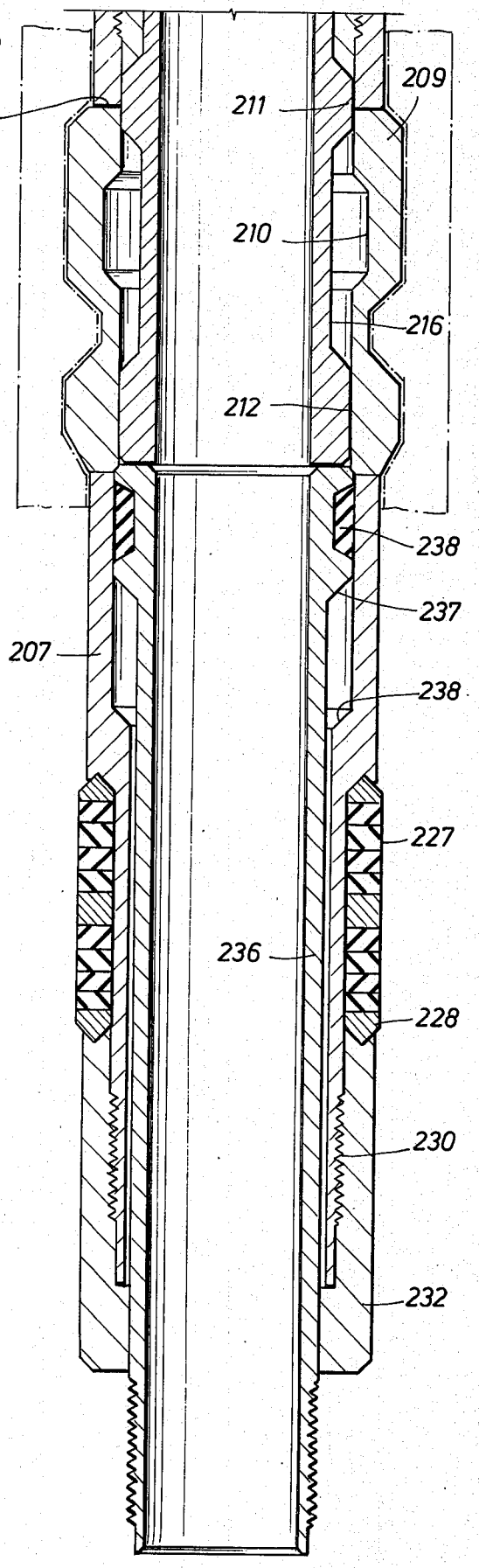

Attention is directed to FIGS. 10A and 10B jointly for a description of the anchor tool 200. An upper outer mandrel 201 includes a facing shoulder which is adapted to be abutted by the running tool. The outer mandrel 201 incorporates first and second internal grooves or receptacles 202 and 203 which are separated by a polished surface 204. They are similar to those illustrated in the embodiments 10 and 100. The receptacles 202 and 203 have the form of internal grooves while the surface 204 has a reduced diameter. The receptacles 202 and 203 are preferably defined by shoulder which extend at about a 45° angle. The surface 204 is preferably polished. An inwardly directed shoulder 205 provides a contoured neck to engage a grappling or fishing tool on retrieval should this need arise. The outer mandrel 201 is fabricated from two different tubular members for ease of fabrication and reduction in cost. The two members are joined at a threaded connection 206 and a lower outer mandrel 207 extends therebelow. The mandrel 207 has two or three windows cut in it at 208 to enable slipmeans 209 to extend therethrough. The slips 209 are similar in construction to the slips 30 shown in FIG. 1. They have an outer surface which is contoured to seat in the nipple in which the tool is to be anchored. The surface is preferably hardened to extend its life. The slips 209 are chamferred at the upper and lower ends. As indicated in the sectional view of FIG. 10B, the slips 209 have an internal groove 210 which mates with an enlargement 211. When the enlargement is positioned in the groove 210, the slips are enabled for retraction. Contrarily, the position of FIG. 10B shows the enlargement 211 shifted relatively upwardly away from the receptacle 210, thereby forcing the slip means 209 radially outwardly. The enlargement 211 is shown in FIG. 10B landing above the receptacle 210. A second and lower enlargement 212 of similar diameter further assists in forcing the slip means 209 radially outwardly.

An inner mandrel 215 is positioned in the outer mandrel 201. The mandrel 215 structurally incorporates the enlargements 211 and 212. The enlargements 211 and 212 are separated by a neck of reduced diameter 216. The enlargements 211 and 212 have a spacing which enable them to nest against the inner upper surfaces of the slip means 209. The neck 216 of reduced diameter spans the receptacle 210. The slip means has a first position which is extended when the enlargements 211 and 212 are positioned just above and below the receptacle 210. A second or retracted position is achieved when the inner mandrel 215 moves relatively downward. When this occurs, the enlargement 211 fits within the receptacle 210. The enlargement 212 is then located below the slip means. This achieves the retracted position of the slip means, freeing the tool for retrieval or run-in.

The inner mandrel 211 includes a number of collet fingers 220 which terminate in enlargements or knuckles at 221. The knuckles are undercut at 222 to provide a receptacle for controllably latching about a disc on a running tool. The collet fingers are separated by longitudinal grooves 223 in the upper end of the inner mandrel. The grooves 223 terminate immediately adjacent to an internal shoulder 224 in the inner mandrel. The shoulder 224 is similar to the shoulder 125 found in FIG. 6.

The inner and outer mandrels cooperate in the manner described heretofore. Relative axial movement to the several positions permitted by the receptacles 202 and 203 engage the collet fingers 220 and the knuckles 221 thereon to attain a running position, a locked position, and a retrieval position. These positions are not shown but the operation of the tool is similar to the embodiments previously described.

In FIG. 10B, the lower outer mandrel 207 has an external portion of reduced diameter where a packing element 227 can be installed. It is formed of resilient material and is held in position by a lock nut 228. The lock nut 228 forces the packer 227 into the desired position. The mandrel 207 terminates in a threaded surface at 230. The reduced diameter at 230 enables the packer to be installed on the mandrel 207.

A bottom mandrel 232 is threaded to the mandrel 207 at 230. The mandrel 232 thus locks the packing element 227 in position when the tool is fully assembled. The lower mandrel 232 serves as an extension to the mandrel 207.

An internal mandrel 236 is slidably received in the mandrel 232. Its downward range of excursion is limited by a downwardly facing shoulder 237. The sleeve 236 carries a seal 238, on its exterior which fully encircles the mandrel 236.

The upward range of travel is shown in FIG. 10B. The mandrel 236 is hydraulically pumped up by bottom pressure creating a differential across the anchor 200. The mandrel 236 moves up to the abutting position of FIG. 10B to prevent downward movement of the upper inner mandrel 215. This prevents release of the anchor 200, from the nipple when pressure from down hole might propel the anchor 200 dangerously up the tubing string. Thus, it is a safety device. When down hole pressure is controlled and no differential across the anchor 200 exists, then the inner upper mandrel can be moved downwardly which movement pushes the lower mandrel 236 easily out of the locking position. This safety feature is similar to that previously disclosed for other embodiments.

This invention in multiple embodiments, is extremely safe and easy to use, and facilitates running, setting and retrieval for the wire line operator.

The slip means are expanded as shown in FIG. 10B in a manner similar to that of the embodiments 10 and 100. Retrieval is achieved by returning the collet enlargements 221 to the lower receptacle 203. This enables the tool to be retrieved upon withdrawal of the slip means. This enables the tool to travel upwardly on retrieval without regard to fluid standing in the well. Communication from the interior to the exterior is permitted.

The embodiment 200 differs somewhat in the arrangement of the various components. A differently contoured set of slips are illustrated. This enables the tool to be set or anchored in a landing nipple having a different internal contour. Different contours can be used to control landing of the anchor tool in a single specified landing nipple. Other landing nipples in the string may have different contours to accept slips of different construction.

I claim:

1. An apparatus useful as a well tool which can be anchored by a setting tool in a well and can be removed and reset thereafter, comprising:

a hollow elongate external mandrel having an external diameter sufficiently small to permit said mandrel to pass along a well pipe;

a hollow internal mandrel slidably disposed within said external mandrel;

slip means movable carried in a recess in said external mandrel, said slip means facing outwardly and radially movable toward the surrounding well pipe and movable radially inwardly therefrom to define a second position retracted from a first extended first position;

an outwardly facing enlargement moved by said internal mandrel and positioned adjacent to said slip means for forcing said slip means to its first position, said internal mandrel being slidably disposed within said external mandrel to position said enlargement at a position relative to said slip means to permit movement of said slip means to the second position;

a set of flexible collet members connected to said internal mandrel above said slip means and exposed in said external mandrel for permitting engagement from above the well tool;

first and second internally located receptacles within said external mandrel;

said collet members flexing outwardly into said receptacles;

said flexible collet members being positioned for selective movement to a point adjacent to said first receptacle, or said second receptacle;

said internal mandrel and said flexible collet members movable as a unit with respect to said external mandrel to a first longitudinal position such that said slip means is in its first position and additionally movable to a second longitudinal position such that said slip means is in its second position;

a lower outer mandrel about said internal mandrel;

a sub axially received in said lower mandrel and exposed to bottom hole pressure, said sub having a cross sectional area across which an upward force is created moving said sub upwardly relative to said internal mandrel; and, a bottom end on said internal mandrel adapted for cooperation with said sub, said sub moving into a position locking said internal mandrel and said enlargement carried thereby relative to said slip means to maintain said slip means in the first position.

2. The apparatus of claim 1 wherein said sub is telescopingly received above an upwardly facing shoulder in said lower mandrel.

3. The apparatus of claim 1 including seal means isolating an axial passage through said sub and into said internal mandrel.

4. The apparatus of claim 1 including an inside face on said slip means, said slip means being formed of a plurality of individual members received in a like number of ports formed in said external mandrel;

a recessed groove on the inside face of said slip means defined by a pair of cading angled shoulders;

said enlargement comprising an annularly directed portion defined by a pair of angled shoulders on said internal mandrel;

said enlargement fitting in said recessed groove, and also alternatively moving to a position adjacent to the inside face of said slip means to move said slip means to the first position.

5. An apparatus useful as a well tool which can be anchored by a setting tool in a well and can be removed and reset thereafter, comprising:

a hollow elongate external mandrel having an external diameter sufficiently small to permit said mandrel to pass along a well pipe;

a hollow internal mandrel slidably disposed within said external mandrel;

slip means movably carried in a recess in said external mandrel, said slip means facing outwardly and radially movable toward the surrounding well pipe and movable radially inwardly therefrom to define a second position retracted from a first extended first position;

an outwardly facing enlargement moved by said internal mandrel and positioned adjacent to said slip means for forcing said slip means to its first position, said internal mandrel being slidably disposed within said external mandrel to position said enlargement at a position relative to said slip means to permit movement of said slip means to the second position;

a set of flexible collet members connected to said internal mandrel above said slip means and exposed in said external mandrel for permitting engagement from above the well tool;

first and second internally located receptacles within said external mandrel;

said collet members flexing outwardly into said receptacles;

said flexible collet members being positioned for selective movement to a point adjacent to said first receptacle, or said second receptacle;

said internal mandrel and said flexible collet members movable as a unit with respect to said external mandrel to a first longitudinal position such that said slip means is in its first position and additionally movable to a second longitudinal position such that said slip means is in its second position; and an undercut shoulder formed on the inside of an enlargement on said collet members, said shoulder being adapted to extend over a mating shoulder on a running in tool which is selectively engaged by and released by said shoulders and said enlargement dependent on the movement of said collet members relative to said first and second receptacles.

6. The apparatus of claim 5 wherein said collet members move radially outwardly into said receptacles when positioned adjacent thereto, and said enlargements move therewith to disengage the running in tool for separation from said well tool.

7. An apparatus useful as a well tool which can be anchored by a setting tool in a well and can be removed and reset thereafter, comprising;

a hollow elongate external mandrel having an external diameter sufficiently small to permit said mandrel to pass along a well pipe;

a hollow internal mandrel slidably disposed within said external mandrel;

slip means movable carried in a recess in said external mandrel, said slip means facing outwardly and radially movable toward the surrounding well pipe and movable radially inwardly therefrom to define a second position retracted from a first extended first position;

an outwardly facing enlargement moved by said internal mandrel and positioned adjacent to said slip means for forcing said slip means to its first position, said internal mandrel being slidable disposed within said external mandrel to position said enlargement at a position relative to said slip means to permit movement of said slip means to the second position;

a set of flexible collet members connected to said internal mandrel above said slip means and exposed in said external mandrel for permitting engagement from above the well tool;

first and second internally located receptacles within said external mandrel;

said collet members flexing outwardly into said receptacles;

said flexible collet members being positioned for selective movement to a point adjacent to said first receptacle, or said second receptacle;

said internal mandrel and said flexible collet members movable as a unit with respect to said external mandrel to a first longitudinal position such that said slip means is in its first position and additionally movable to a second longitudinal position such that said slip means is in its second position;

a slidable lower mandrel concentric with and longitudinally offset from said internal mandrel;

a packer element about said lower mandrel;

expander means operated on relative upward movement of said lower mandrel for expanding said packer element into sealing engagement with a surrounding well pipe; and holding means for releasably holding said lower mandrel in a raised position relative to other portions of said well tool.

8. The apparatus of claim 7 wherein said holding means includes a set of outwardly facing serrations;

a similar set of inwardly facing mating serrations spaced from said first serrations;

said holding means and said lower mandrel being relatively movable to said serrations into locking positions engaged with one another, said serrations holding said lower mandrel in the raised position.

9. The apparatus of claim 7 including release means cooperative with said holding means to return said lower mandrel toward its original relative position.

10. The apparatus of claim 7 including upper and lower shoulder means on said packer element;

a downwardly facing shoulder on said external mandrel abutting said upper packer element shoulder means;

an upwardly facing shoulder on said lower mandrel abutting said lower packer element shoulder means;

said lower mandrel being positioned for upward and downward movement axially of said external mandrel; and, additional shoulder means cooperative with said lower mandrel and said external mandrel for limiting upward movement of said lower mandrel.

11. The apparatus of claim 10 including means for connecting said lower mandrel with a running in tool and for enabling such a running in tool to raise said lower mandrel to expand said packer element.

12. The apparatus of claim 10 includes wherein said holding means radially outwardly flexible collet fingers on said lower mandrel; and, means interiorly located of said external mandrel for engaging and holding said collet fingers on upward movement of said collet fingers.

13. The apparatus of claim 12 wherein said holding means further includes an engaging set of serrations on the exterior of said collet fingers and a similar set interiorly located of said collet fingers, said serrations locking on upward movement of said lower mandrel and holding after locking by flexure of said collet fingers.

14. The apparatus of claim 13 including a chamferred upper shoulder on said collet fingers, and a downwardly facing edge means carried on said internal mandrel at the lower portions thereof, said edge means being guided by said upper shoulder to a position separating said serrations from one another to enable said lower mandrel to move relatively downward.

15. The apparatus of claim 14 wherein said edge means moves between said sets of serrations by flexing said collet fingers inwardly.

* * * * *